United States Patent [19]

Schäfer

[11] Patent Number: 4,989,423

[45] Date of Patent: Feb. 5, 1991

[54] WARP KNITTING MACHINE WITH GUIDE BARS ADJUSTABLE BY MEANS OF STEP MOTORS

[75] Inventor: Helmut Schäfer, Neuffen, Fed. Rep. of Germany

[73] Assignee: Liba Maschinenfabrik GmbH, Fed. Rep. of Germany

[21] Appl. No.: 381,416

[22] PCT Filed: Oct. 6, 1988

[86] PCT No.: PCT/DE88/00619

§ 371 Date: Jul. 21, 1989

§ 102(e) Date: Jul. 21, 1989

[87] PCT Pub. No.: WO89/03443

PCT Pub. Date: Apr. 20, 1989

[30] Foreign Application Priority Data

Oct. 8, 1987 [DE] Fed. Rep. of Germany ..... 3734072

[51] Int. Cl.[5] ..... D04B 23/22

[52] U.S. Cl. ..... 66/204

[58] Field of Search ..... 66/203, 204, 207

[56] References Cited

U.S. PATENT DOCUMENTS

| | | | |
|---|---|---|---|
| 4,570,462 | 2/1986 | Roth | 66/204 |
| 4,611,475 | 9/1986 | Bergmann | 66/207 |
| 4,614,095 | 9/1986 | Porat | 66/207 |
| 4,761,973 | 8/1988 | Gangi | 66/207 |

FOREIGN PATENT DOCUMENTS

| | | | |
|---|---|---|---|
| 3403581 | 10/1984 | Fed. Rep. of Germany | 66/207 |
| 0244368 | 4/1987 | Fed. Rep. of Germany | 66/207 |
| 0251807 | 11/1987 | German Democratic Rep. | 66/203 |

OTHER PUBLICATIONS

Knitted Outerwear Times, 48-Bar Raschet Has Unit Operator at 260 RPM, vol. 37, No. 42, 10-1978, pp. 86-87.

*Primary Examiner*—Werner H. Schroeder
*Assistant Examiner*—John J. Calvert
*Attorney, Agent, or Firm*—Bell, Seltzer, Park & Gibson

[57] ABSTRACT

Warp knitting machine with guide bars adjusted according to a pattern by means of displacement stepping motors, which receive their displacement information in the form of a certain number of displacement pulses from a pattern memory of a control device.

For determining and correcting the guide bar position of a warp knitting machine shut down in underlay position, the indicator of an electrical proximity switch is connected with each guide bar, whose sensor is mounted on a measurement slider shiftable in the displacement direction of the guide bar, said slider being shiftable by means of a measurement stepping motor over the displacement range of the indicator beginning from a start position, which corresponds to the zero-position of the guide bar. A pulse counter is provided for counting the steps of the measurement stepping motor during this shifting up to the point of coincidence of the indicator and sensor, whose counting result is compared by means of a comparator with the displacement pulse number defining the shifting for a given pattern, which is obtainable from the pattern memory. The difference determined by the comparator is fed to the associated displacement stepping motor as a correction pulse number.

4 Claims, 2 Drawing Sheets

WARP KNITTING MACHINE WITH GUIDE BARS ADJUSTABLE BY MEANS OF STEP MOTORS

The invention relates to a warp knitting machine whose guide bars are displaced according to a pattern by means of displacement step motors, which obtain their displacement information in the form of a certain number of displacement pulses (displacement pulse number) from a pattern memory in a control device.

An apparatus for this type of control of a warp knitting machine is known from the German Pat. No. 24 19 694. A warp knitting machine controlled in this manner must be shut down, for example during work interruption overnight and operation interruption can also occur through power failure.

During shut down, power failure and in particular through short-time power interruption it can not be excluded that disturbances overlap the displacement pulses so that the guide bars are in a false displacement position. It is therefore the object of the invention to insure that the guide bars retain their correct positions according to the pattern when restarting.

In accordance with the invention this is achieved in that each guide bar is connected to the indicator of an electrical proximity switch, for detecting and correcting the position of the guide bars of a warp knitting machine shut down in the underlay position, whose sensor is mounted on a measuring slider shiftable in the displacement direction of the guide bars. The slider is shiftable over the displacement region of the indicator by means of a measurement step motor beginning from a starting position, which corresponds to the zero-position of the guide bar. In addition, a pulse counter is provided for counting the steps of the measurement step motor during this shifting until the indicator and sensor coincide and counted number is compared by means of a comparator with the displacement pulse number taken from the pattern memory, which defines the required shift according to the pattern. The correction pulse number determined as the difference in the comparator is supplied to the respective displacement step motor.

In this manner the respective positions of the individual guide bars are determined absolutely by means of the measurement slider when the warp knitting machine shuts down in the underlay position, namely by counting the steps of the measurement step motor when shifting the measurement slider in the form of electrical pulses where an individual number of pulses results for each guide bar. The counting of these pulses begins at a starting position of the measurement slider, which corresponds to the zero-position of the guide bar or respectively guide bars. This number of pulses taken as the result of a pulse counter which counts the steps of the measurement step motor is then compared with the displacement pulse number which is available as displacement information from the pattern memory in the control device and which indicates the position which the concerned guide bar should retain depending on the stored pattern. This comparison of the displacement pulse number obtained from the pattern memory with the count result of the mentioned pulse counter then takes place by means of a comparator. The difference determined by this comparison represents a correction pulse number, which is then supplied to the respective displacement step motor. The displacement step motor, depending on the sign of the difference determined in the comparison, then carries out a corresponding number of steps in the forwards or backwards direction, whereby the concerned guide bar is brought into the position where it should be according to the displacement pulse number taken from the pattern memory. The warp knitting machine can then be started again and the guide bars are located in the correct position for the respective pattern.

Since a warp knitting machine normally is equiped with several guide bars, one can mount several sensors on one measurement slider which is shifted by one common step motor for measurement. When the individual indicators pass over the respective sensors, the number of steps up to that point are stored for the indicator and its associated guide bar, where possibly for each sensor, i.e. for each individual guide bar, an individual number of steps results. These individual numbers of steps are then compared with the displacement pulse number taken from the pattern memory by means of a comparator in the manner described above, where upon each guide bar is individually brought into the required position by the stepping motor for displacement, in case this is found necessary on the basis of the comparison.

To determine the position of each guide bar by means of the measurement slider with particular accuracy, it is expedient to provide the measurement stepping motor with a smaller subdivision as the stepping motor for displacement, i.e. the pulse number supplied to the step motor for measurement required for a certain shifting path of the sensor is a multiple of the pulse number for the same shifting path required by the step motor for displacement. When for example the stepping motor for displacement must receive eight pulses for shifting by one needle pitch, then according to the above rule, the stepping motor for measurement can carry out four times the number of steps for the same shifting path, i.e. thirty two steps. In this manner, due to the large number of steps made by the measurement motor, a high resolution with particularly short steps is achieved when determining the position of the guide bars. Naturally, this relationship must be considered when making the comparison of the pulse number derived from the measurement stepping motor and the displacement pulse number taken from the pattern memory.

The indicator and sensor of the proximity switch can of course be interchanged, i.e. it is also possible to mount the indicator on the measurement slider and to couple the sensor to the guide bar.

An embodiment of the invention is shown in the figures. It contains only those parts of a warp knitting machine necessary for understanding the invention.

Figure 1:
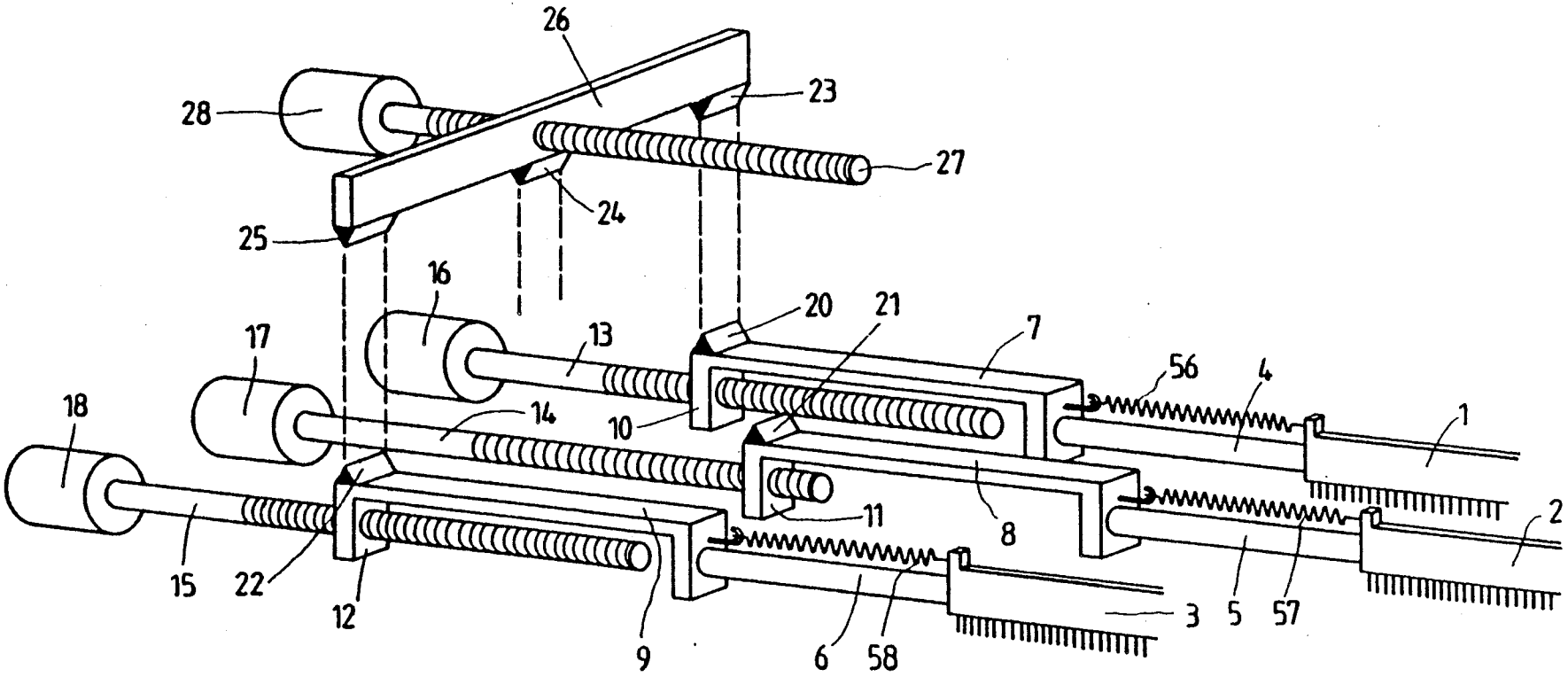
FIG. 1 shows a perspective view of the relevant parts of the warp knitting machine.

FIG. 1 shows three guide bars 2, 2, 3 of a warp knitting machine configured in the usual manner, which are shifted back and forth by the push rods 4, 5 and 6 according to a predetermined pattern. The push rods 4, 5 and 6 are coupled to the female runners 7, 8 and 9 being baised by the springs 56, 57 and 58. The runners terminate at the end opposite to the push rods 4, 5 and 6 in nut-portions 10, 11 and 12. These nut-portions 10, 11 and 12 engage with spindles 13, 14 and 15 provided with corresponding threadings, so that when the spindles 13, 14 and 15 rotate, the female runners 7, 8 and 9, fixed against rotation in a known way, move in the longitudinal direction. They then provide the required shifting of the guide bars 1, 2 and 3 via the push rods 4, 5 and 6.

The required rotation of the spindles 13, 14 and 15 necessary for this shifting arises by means of displacement stepping motors 16, 17 and 18 which drive the spindles. The stepping motors 16, 17 and 18 for displacement obtain the respective displacement information in the form of pulses from the control device 19, whose function will be described in detail in conjunction with FIG. 2. It is also clear that more or less than three such arrangements with guide bars 1, 2 and 3 can be provided.

The indicators 20, 21 and 22 of proximity switches are mounted on the female runners 7, 8 and 9 and the switches have associated sensors 23, 24 and 25. These sensors 23, 24 and 25 are mounted on the measurement slider 26. Thus, one proximity switch consists of an indicator 20 and the associated sensor 23. The proximity switches are known devices which generate an electric pulse when the indicator and sensor match up. The slider 26 engages with the spindle 27 which is driven by the stepping motor for measurement. The spindle 27 is received by the slider 26 in a female thread, so that when rotating the spindle 27, the slider 26, which is secured against rotation moves in the direction of the displacement of the guide bars 1, 2 and 3.

The measurement slider 26 with the sensors 23, 24 and 25 is illustrated in FIG. 1 at a distance from the female runners 7, 8 and 9. This has been done for illustration purposes. Actually, the slider 26 is mounted closely adjacent to the female runners 7, 8 and 9, in any case such that the indicators 20, 21 and 22 can be brought into the necessary matching position with respect to the associated sensors 23, 24 and 25 for the functioning of the respective proximity switches.

During operation of the warp knitting machine, the displacement stepping motors 16, 17 and 18 receive their individual displacement information in the form of pulses, whereby the stepping motors 16, 17 and 18 for displacement carry out a corresponding number of rotational steps providing the desired and necessary shifting of the guide bars 1, 2 and 3 in the above mentioned manner. For a displacement of the guide bars 1, 2 and 3 by a length corresponding to one needle spacing, eight steps could for example be specified for the respective displacement motors 16, 17 and 18. The stepping motors 16, 17 and 18 obtain these displacement pulses from the control device 19 (see FIG. 2) as stated above. The control device 19 also supplies the pulses necessary for driving the measurement stepping motor 28.

The function of the warp knitting machine controlled according to the above described principle will now be explained in conjunction with FIG. 2.

Figure 2:
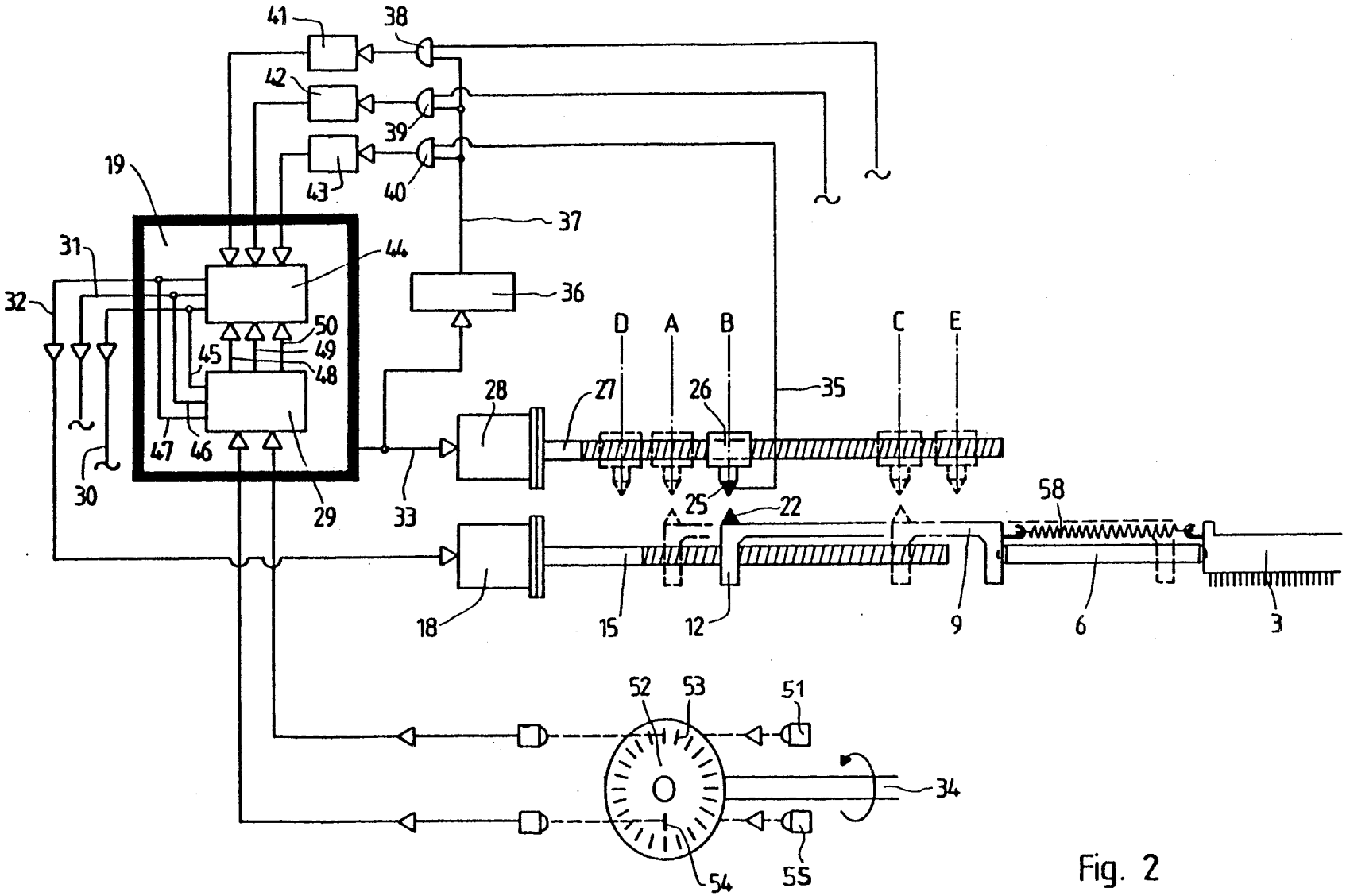
FIG. 2 shows a portion of FIG. 1 with the essential functional parts.

To illustrate the respective positions of the components of the knitting machine considered here, the arrangement is shown in side view in FIG. 2, whereby only the part acting with the guide bar 3 is shown. The same control and function exists for the other guide bars 1 and 2.

It is assumed that due to some disturbance, for example a short power failure, the displacement pulse sequence fed on the line 32 is overlaped with a disturbance voltage, which leads to cancellation of two pulses of the pulse sequence on this line. The stepping motor 18 then moves the associated guide bar 3 by a shortened displacement, whereby the shortened amount corresponds to these two pulses. The consequence of this can be contact between the associated guide pin and the knitting needle when the guide bars pass through the needle path, which can lead to yarn breakage or even to damage on the knitting head. If a larger number of pulses are cancelled, this can lead to such a large displacement error of the concerned guide bar that a distortion in the pattern to be knitted becomes apparent. It is also possible that such electrical disturbances, add pulses to the displacement pulse sequence in an undesired manner, which then leads to a correspondingly longer displacement movement.

The length of such a displacement error of one guide bar 1, 2 or 3 is determined as follows. The warp knitting machine is shut down, namely its stops in an angular range of the main shaft 34 which corresponds to the underlay position of the guide bars. In the underlay position of the guide bars, these can be moved longitudinally with respect to the knitting head without collision with the knitting needles of the head and without danger for the guided threads. The underlay position is namely that position maintained by the guide bars during normal operation of the machine to carry out the movements necessary for pattern formation. The underlay position therefore encomposes the entire displacement range of the guide bars for laying the threads according to the pattern. The warp knitting machine can be put into this angular position of the main shaft for example in slow gear.

In the example shown in FIG. 2, the guide bar 3 and thus the indicator 22 are located in the position designated by the dot-dashed line B. For the concerned warp knitting machine, the displacement region of the guide bar 3 and thus the indicator 22 within the underlay position extends from the position A to the position C. The sensor 25 associated with the indicator 22 is located at its starting position which also corresponds to the position A. This starting position thus determines the zero-position of the guide bar 3. The stepping motor 28 for measurement now begins operation, which drives spindle 27 by rotation and thus moves the measurement slider 26 with its sensor 25 in the displacement direction, namely to the end of the displacement region at the dot-dashed line C. The sensor 25 passes the indicator 22 along this path. When the sensor 25 coincides with the indicator 22, the sensor 25 gives off a pulse on the line 35.

The stepping motor 28 receives pulses from the control device 19 for its rotation, which are simultaneously fed to the counter 36. Each pulse corresponds to a certain step, depending on the gearing of the stepping motor, and thus to a corresponding longitudinal movement of the sensor 25. The pulses or steps of the measurement stepping motor 28 counted by the counter are supplied via the line 37 and the gate switches 38, 39 and 40 to the registers 41, 42 and 43, where register 43 is allotted to the guide bar 3 and the indicator 22. A similar situation holds for the other registers 41 and 42. The gate 40 is blocked by the pulse given out by the sensor 25 when coincidence of the sensor 25 and the indicator 22 is reached, so that register 43 stops with the indication of the number of steps which have been taken by the measurement stepping motor 28 up to that point. With reference to FIG. 1 it is noted that the registers 41 and 42 stop at values of the counter 36 which correspond to the respective positions of the indicators 20 and 21.

To then determine whether the positions of the indicators 20, 21 and 22 obtained as the pulse numbers in the registers 41, 42 and 43 and thus the positions of the guide bars 1, 2 and 3 actually correspond to those which the guide bars 1, 2 and 3 should actually have in operation, the following procedure is then undertaken. These pulse numbers are compared with the number of steps which the concerned displacement stepping motor 16, 17 and 18 have taken in moving the associated guide bar into the determined position. This comparison is carried out by means of the comparator 44 contained in the control device 19, which receives on the one hand, the pulse numbers stored in the registers 41, 42 and 43 and on the other hand the respective displacement pulse number from the pattern memory 29. The pattern memory 29 stores the pattern to be knitted by the warp knitting machine in a known way, i.e. in normal operation, the pattern memory 29 supplies displacement pulses via its terminals 45, 46 and 47 to the lines 30, 31 and 32, which rotate the stepping motors for displacement corresponding to the respective number of displacement pulses and therefore correspondingly shift the guide bars 1, 2 and 3. The number of pulses for displacement stored in the pattern memory 29 for each guide bar 1, 2 and 3 are then supplied to the comparator 44 via the lines 48, 49 and 50, which compares these pulse numbers with the pulse numbers delivered by the registers 41, 42 and 43. The respective differences obtained in the comparator are then fed via the lines 30, 31 or 32 to the respective displacement stepping motor 16, 17 or 18 as a sequence of pulses (number of correction pulses). The consequence of this is that based on the position of the guide bars 1, 2 and 3 and thus the indicators 20, 21 and 22 determined by means of the slider 26 with its sensors 23, 24 and 25, the displacement stepping motors 16, 17 and 18 then carry out the number of steps such that the guide bars 1, 2 and 3 arrive in their end-position necessary for the respective process. Thus it is guaranteed that all guide bars are located in the displacement position required for the end of an underlay according to the pattern. If one of the guide bars 1, 2 or 3 was previously in a position differing by one or more steps of the concerned stepping motor 16, 17 or 18 from the actual required position, this will have been compensated based on the comparison made in comparator 44 of the pulses contained in the registers 41, 42 and 43 and the correct number of pulses according to the pattern obtained from the pattern memory 29.

Based on the above described rotation of the stepping motors 16, 17 and 18, the guide bars 1, 2 and 3 are in the correct end position for the displacement movement in question, however, as explained above, the warp knitting machine was shut down in an angular position of the main shaft 34 which corresponds to any position in the displacement region. This means that normally the main shaft 34 is retarded with respect to the position of the guide bars 1, 2 and 3 now taken.

Therefore, the angular position of the main shaft 34 must be brought into phase with the position of the guide bars 1, 2 and 3 or in other words, the main shaft 34 must be rotated without movement of the guide bars 1, 2 and 3 by a certain angle, so that after reaching this angular position, the main shaft 34 can be further rotated synchroneously or in phase with the movement of the guide bars 1, 2 and 3.

To rotate the main shaft 34 into the correct phase with respect to the position of the guide bars 1, 2 and 3, a slit disk 52 which is scanned by a light source 51, is arranged on the main shaft 34, which being fixed to the main shaft 34 rotates with it and therefore generates pulses by means of the slits 53 and the source 51. The pulses thus generated by the source 51 are supplied to the pattern memory 29 as synchronization pulses. Apart from the series of slits 53, a reference slit 54 is provided in the slit disk 52, with which a reference pulse is generated by means of the reference source 55 when a certain angular position of the main shaft 34 is reached. This reference pulse is also fed to the control device 19 and the pattern memory 29 therein. It signals the control device that the main shaft 34 has reached a position which exactly corresponds to the end of the displacement movement of the guide bars 1, 2 and 3. When this reference pulse derived from the reference source 55 is entered, the control device 19 is activated so that starting from the angular position of the main shaft 34 defined by the reference pulse, the further control and thus the movement of the guide bars 1, 2 and 3 occurs, namely exactly with the correct adjustment of the guide bars according to the pattern.

In FIG. 2, the positions of the sensor 25 (and correspondingly also sensors 23 and 24) are indicated by the dot-dashed lines D and E, which go beyond the displacement range defined by the lines A and C. For the above described determination of the guide bar position, the region lying between the lines A and C is sufficient in general, which corresponds to the maximal displacement range of the guide bars 1, 2 and 3 for the underlay position. However, it can be expedient to extend the sensor 25 beyond the region between lines A and C, namely for a reliable determination of all possible positions of the guide bars 1, 2 and 3. This holds in particular if when shutting down the knitting machine to determine the position of the guide bars 1, 2 and 3 it can occur that one or more of the guide bars is in its respective end position. When I0 such a region is provided between the lines A and C, it should naturally be insured that a number of pulses is added in the control of the measurement stepping motor, which corresponds to the length between the lines A and D and C and E. The zero-position of the guide bars 1, 2 and 3 is still at the point A, which must be considered when evaluating the correction pulses. It is further noted that after a run through of the measurement slider 26, the slider should be returned to the starting position, i.e. according to the above embodiment to the position A or possibly to the position D.

The described determination and possible correction of the guide bar positions can now also be made when shutting down the warp knitting machine after working hours, for example at the beginning of each working day. This envolves a routine check of the correct position of the guide bars according to the desired pattern.

The described steps for determining and possible correction of the guide bar positions can be advantageously applied when a new pattern is to be knitted with the machine. In this case, the new pattern is entered into the pattern memory 29, if not already stored there. Then, according to the above mentioned procedure, the guide bar positions are determined when the knitting machine is turned off in the underlay position. The guide bars can be in an arbitrary position. The comparator 44 is supplied with the pulse numbers from the registers 41, 42 and 43 based on the determination of the guide bar positions, whereupon the displacement pulse numbers determined by the new pattern are taken from the pattern memory 29 and also fed to the comparator 44. Based on the following comparison made in the manner described above, the guide bars are then moved to their end position given by the new pattern in the respective underlay position.

I claim:

1. In a warp knitting machine with guide bars (1, 2, 3) shiftable in a longitudinal displacement direction by means of displacement stepping motors (16, 17, 18) according to a pattern, wherein said displacement stepping motors (16, 17, 18) obtain their displacement information in the form of a certain number of displacement pulses from a pattern memory (29) in a control device (19), the combination therewith of means for determining and correcting the position of said guide bars (1, 2, 3) of said knitting machine turned off in the underlay position, said guide bar position determining and correcting means including indicators (20, 21, 22) of an electric proximity switch connected to each of said guide bars (1, 2, 3), sensors (23, 24, 25) mounted on a measurement slider (26) shiftable in the displacement direction of said guide bars (1, 2, 3), said measurement slider (26) being shiftable from a start position (A) over a displacement region of said indicators (20, 21, and 22) by means of a measurement stepping motor (28), said start position (A) corresponding to the zero-position of said guide bars (1, 2, 3), a pulse counter (36) for counting the steps of said measurement stepping motor (28) during shifting to a point of coincidence of said indicators (20, 21, 22) and said sensors (23, 24, 25), a comparator (44) for comparing the steps of said measurement stepping motor (28) with the displacement pulse number obtained from a pattern memory (29) defining the respective displacement according to the pattern, and wherein a difference determined by said comparator (44) is fed to the corresponding displacement stepping motors (16, 17, 18) as a correction pulse number.

2. Apparatus according to claim 1, wherein several sensors (23, 24, 25) are mounted on one measurement slider (26) which is shifted by a common measurement stepping motor (28).

3. Apparatus according to claim 1 or 2, wherein the pulse member required for a certain shifting path of said sensors (22, 24, 25) and supplied to the respective measurement stepping motor (28) is a multiple of the pulse number fed to said displacement stepping motors (16, 17, 18) for the same shifting path.

4. Apparatus according to claim 1, wherein said indicators (20, 21, 22) and said sensors (23, 24, 25) of said proximity switch are interchangeable with one another.

* * * * *